United States Patent [19]

Lubowitz et al.

[11] 3,980,509

[45] Sept. 14, 1976

[54] SOLID FLUORO-OXIDIZER SYSTEMS FOR CHEMICAL LASERS

[75] Inventors: Hyman R. Lubowitz, Hawthorne; William G. Gaskill, Long Beach, both of Calif.

[73] Assignee: TRW Inc., Redondo Beach, Calif.

[22] Filed: Aug. 7, 1975

[21] Appl. No.: 602,628

[52] U.S. Cl. ..... 149/19.3; 149/20; 149/109.2; 149/119

[51] Int. Cl.[2] ..... C06B 45/10

[58] Field of Search ..... 149/19.3, 19.91, 20, 149/109.2, 119

[56] References Cited

UNITED STATES PATENTS

| | | | |
|---|---|---|---|
| 3,669,020 | 6/1972 | Waite et al. | 149/19.3 X |
| 3,732,132 | 5/1973 | Merrow et al. | 149/19.3 X |
| 3,752,703 | 8/1973 | Toy et al. | 149/19.1 |
| 3,753,811 | 8/1973 | Julian et al. | 149/20 X |
| 3,797,238 | 3/1974 | Iwanciow et al. | 149/19.3 X |
| 3,863,176 | 1/1975 | Martinez et al. | 331/94.5 P |

OTHER PUBLICATIONS

Christe et al., *Inorganic Chemistry*, 12, 2478–2481 (1973).

Goetschel et al., *Inorganic Chemistry*, 11, 1696–1701 (1972).

*Primary Examiner*—Edward A. Miller

*Attorney, Agent, or Firm*—Daniel T. Anderson; Willie Krawitz; Alan D. Akers

[57] ABSTRACT

This invention relates to laser fuels and, more specifically, to solid fuels suitable for use in a chemical laser.

1 Claim, No Drawings

SOLID FLUORO-OXIDIZER SYSTEMS FOR CHEMICAL LASERS

BACKGROUND OF THE INVENTION

In the operation of chemical lasers, particularly the combustion-driven type, a fuel is burned in a combustor portion of the laser to form free atoms. These free atoms are then forwarded along with the other combustor gases to a cavity portion of the laser where they are reacted with a cavity fuel to form a lasing species. Lasing action takes place in the cavity after which the decayed lasing species and remaining gases are then removed from the cavity.

Typically, in a combustion driven chemical laser, an excess of atomic fluorine is produced in the combustor by burning a fuel, and the combustor products, including the atomic fluorine are forwarded at supersonic speed to the cavity. Hydrogen or deuterium fuel is introduced into the cavity and reacts with the atomic fluorine to form the lasing species HF* or DF*. Decay of the lasing species to ground level produces laser emission at 2.6$\mu$ to 2.9$\mu$ for HF and 3.6$\mu$ to 4.0$\mu$ for DF. Reactions in the combustor are as follows when employing a hydrogen-fluorine or a deuterium-fluorine fuel system:

$$H_2 + F_2 \text{ (excess)} \longrightarrow HF + F^\circ$$

or $$D_2 + F_2 \text{ (excess)} \longrightarrow DF + F^\circ$$

The combustor reaction takes place at pressures ranging from about 10-200 psi and temperatures of about 1400°K–3000°K. The high temperatures ensure total fluorine dissociation into atomic (i.e., free) fluorine.

If $H_2$, benzene, etc. are employed in the combustor to form HF and free fluorine, deuterium is employed as the cavity fuel and vice versa. The reaction in the laser cavity is as follows:

$$2F + D_2 \longrightarrow 2DF^*$$

or $$2F + H_2 \longrightarrow 2HF^*;$$

where DF* and HF* are the lasing species.

Cavity pressures vary from about 1–20 torr and cavity temperatures from about 300°K–900°K. The spent reactants must be removed from the cavity at supersonic speeds since the ground state species will quench the lasing reaction.

Storing fluorine for chemical lasers presents problems because it is highly toxic and extreme precaution must be taken therefore to ensure fluorine containers are leakproof. When in use, chemical lasers employing fluorine present an additional hazard due to leakage from valves joints, etc.

Hence, it would be desirable to generate fluorine compounds for lasers from solid grains which would be inert at room temperature. At relatively high temperatures, the grains would release fluorine, or compounds with utilizable fluorine, to the laser. At the same time, the generation of fluorine must not release byproducts which will clog, damage or react with the laser components. In particular, feed nozzles from the combustor to the cavity and optical components are the two most vulnerable areas. Finally, the solid grains must be relatively inexpensive, and easy to prepare and handle.

THE INVENTION

According to the invention, there are provided solid grain compositions which can produce fluorine or fluorine containing compounds for use in a chemical laser comprising:

a. Oxidizing salts containing fluorine. Typical salts are $NF_4BF_4$, $NF_4SbF_6$, $N_2F_5AsF_6$, $N_2F_4AsF_5$, $NF_4AsF_6$, $NF_3HBF_4$, $NF_3HClF_3$, $N_2F_4HBF_4$, $N_2F_5BF_4$, $KClF_4$, $SF_5NF_2$, $Ba(BrF_4)_2$, $LiClF_4$, $KBrF_4$, $SF_3BF_4$, $CsSF_5$, etc.; the metal component of the oxidizer salt is preferably Sb, As and B.

b. A polymer fuel material which also functions as a binder for the salts and other additives. Typical polymer fuels include polychlorotrifluoroethylene (KEL-F) and polytetrafluoroethylene (e.g., teflon) type polymers, perfluoropolybutadiene, perfluoropolyisobutylene, perfluoropolyisoprene, perfluoropolychloroprene and perfluoropolypropylene.

c. An alkali metal fluoride which functions to sequester any metal fluorides ($BF_3$, $SbF_5$, etc.) and prevent their volatization into the laser; the use of an alkali metal fluoride is optional. Typical alkali metal fluorides are KF, CsF, $BaF_2$, RbF, $CaF_2$, etc.

d. An augmenting fuel which enhances the energy of combustion; the use of an augmenting fuel is optional. Typical fuels include Mg, $Mg_3N_2$, Al, AlN, B, Be, C, etc.

e. Plasticizers for improving the handling properties of the fuel and which also have fuel properties; the use of plasticizers is optional. Typical plasticizers include low molecular weight polymers in the form of oils and greases such as polychlorotrifluoroethylene, polytetrafluoroethylene and perdifluoroaminoperfluorobutadiene. This latter compound also increases the amount of nitrogen available to the laser as an inert diluent. It has the formula:

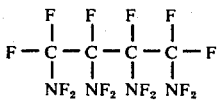

The components in the solid grain fuel have about the following preferred range of weights:

| | |
|---|---|
| a) Oxidizing salt: | 55% – 98%; |
| b) Polymer fuel: | 4% – 45%; |
| c) Alkali metal fluoride: | 0% – 20%; |
| d) Augmenting fuel: | 0% – 10%; and |
| e) Plasticizer: | 0% – 25%. |

Typical examples of laser fuels according to this invention are shown in the following table:

EXAMPLES

| | 1 | 2 | 3 | 4 | 5 | 6 | 7 | 8 | 9 | 10 | 11 |
|---|---|---|---|---|---|---|---|---|---|---|---|
| Oxidizer | | | | | | | | | | | |

EXAMPLES-continued

| | 1 | 2 | 3 | 4 | 5 | 6 | 7 | 8 | 9 | 10 | 11 |
|---|---|---|---|---|---|---|---|---|---|---|---|
| Salt (%) | 80[1] | 80[1] | 70[1] | 75[1] | 60[1] | 88[1] | 87[1] | 70[1] | 80[1] | 80[6] | 70[6] |
| Polymer Fuel (%) | 20[2] | 10[2] | 10[2] | 15[2] | 20[2] | 10[2] | 10[3] | 30[3] | 20[3] | 20[2] | 30[3] |
| Augmenting Fuel (%) | | | | | | 2[5] | 3[5] | | | | |
| Plasticizer (%) | | 10[4] | 20[4] | 10[4] | 20[4] | | | | | | |
| Combustion Temp (°K) | 2192 | 1474 | 1812 | 1986 | 3308 | 2005 | 2076 | 1777 | 1201 | 2308 | 1709 |
| Principal Eff. F°(%) | 18.5 | 6.3 | 14.7 | 17.1 | 9.6 | 21.9 | 21.2 | 11.1 | 1.7 | 13.9 | 8.3 |
| Gases $N_2$(%) | 0.10 | 0.13 | 0.14 | 0.12 | 0.15 | | | | | | |

1. $NF_4BF_4$; 2. Perfluoropolybutadiene (PFPB): 3. Teflon; 4. $C_4N_4F_{14}$; 5. Boron; 6. $NF_4AsF_6$ The solid grain fuels are produced by blending the powdered ingredients together and then compressing them to their final shape. Generally, the shape of the solid grain may be in the form of solid rods, circular annular rods, star-shaped annular rods, etc.

When employing teflon or similar material as the polymer fuel, the powdered ingredients, including the teflon in powdered form, are hot pressed at ambient temperatures up to about 200°F and about 500 psi. This causes the teflon to cold flow and coat the remaining powdered ingredients.

When employing perfluoropolybutadiene (PFPB) as the polymer fuel, the PFPB is dissolved in a solvent such as a freon at room temperature and for convenient periods of time such as up to about ½ hour. The remaining components are solvent coated with the freon solution containing the dissolved PFPB; the freon is then removed by evaporation and may be recovered.

The solid grain laser fuel of this invention may be employed suitably in a portable laser device such as shown in U.S. Pat. No. 3,863,176 to John S. Martinez et al issued Jan. 28, 1975

In a typical reaction (Example 1), $$\text{PFPB (20\%)} + NF_4BF_4\ (80\%) \xrightarrow{2192°K} 18.5\%F° + 0.10\%N_2.$$

Note the atomic fluorine can be produced by the heat of reaction before the fluorine even enters the combustor. Also, hydrogen is not required as a combustor reactant. Where an alkali metal fluoride is employed as a sequestering agent in the solid grain composition, the product remaining after completion of the reaction has a clinker-like consistency. Consequently, the generation of atomic fluorine will not release by-products which will clog, damage or react with laser components to impair the short term viability of the device.

In examples 1–11, the amount of polymer fuel employed together with the high combustion temperatures of the solid grain produced a relatively high amount of atomic fluorine as a reaction product. However, if the combustion temperature is lowered, or if less polymer fuel is employed, the reaction products are mainly a mixture of $NF_3$, $F_2$, $CF_4$ and $BF_3$. Sequestering of $BF_3$ with an alkali metal fluoride produces $NF_3$, $F_2$ and inert $CF_4$. A typical reaction is:

$$\underset{(10\%)}{\text{Teflon}} + \underset{(90\%)}{NF_4BF_4} \xrightarrow[\text{KBr}]{670°-800°K} NF_3 + F_2 + CF_4$$

In general, a suitable range of reaction temperatures necessary to produce $NF_3$ and $F_2$ is about from 400° to 1000°F.

Reaction of an excess of $NF_3$ and/or $F_3$ in the combustor with, say hydrogen, benzene, or other hydrocarbons will produce atomic fluorine for further reaction in the laser cavity to produce a lasing species.

Thus the solid grain fuels of this invention not only provide a source of fluorine in a stable form for a chemical laser but also permit easier and convenient handling with no major problems involving production of undesirable by-products. Furthermore, the ingredients are not expensive and are easy to formulate.

We claim:

1. A solid grain fuel for a chemical laser comprising:

a. an oxidizing salt comprising: $NF_4BF_4$, $NF_4SbF_6$, $NF_3HClF_3$, $N_2F_4HBF_4$, $N_2F_5BF_4$, $KClF_4$, $LiClF_4$, $KBrF_4$, $Ba(BrF_4)_2$, $SF_5NF_2$, $SF_3BF_4$, $CsSF_5$, and mixtures thereof;

b. a polymer fuel material comprising: polychlorotrifluoroethylene, polytetrafluoroethylene, perfluoropolybutadiene, perfluoropolyisobutylene, perfluoropolyisoprene, perfluoropolychloroprene, and perfluoropolypropylene, and mixtures thereof;

c. an alkali metal fluoride comprising: CsF, $BaF_2$, KF, RbF, $CaF_2$, and mixtures thereof;

d. an augmenting fuel comprising: Mg, $Mg_3N_2$, Al, AlN, B, C, Be, and mixtures thereof;

e. a plasticizer comprising: polychlorotrifluoroethylene, polytetrafluoroethylene, and perdifluoroaminoperfluorobutadiene in the form of oils and greases.

* * * * *